US010350733B2

(12) United States Patent
Zhao et al.

(10) Patent No.: US 10,350,733 B2
(45) Date of Patent: Jul. 16, 2019

(54) ULTRA-HARD MATERIAL CUTTING ELEMENTS AND METHODS OF MANUFACTURING THE SAME WITH A METAL-RICH INTERMEDIATE LAYER

(71) Applicant: Smith International, Inc., Houston, TX (US)

(72) Inventors: Liang Zhao, Spring, TX (US); Xiaoge Gan, Houston, TX (US); Yahua Bao, Orem, UT (US); Yuri Y. Burhan, Spring, TX (US); Youhe Zhang, Spring, TX (US); J. Daniel Belnap, Lindon, UT (US); Zhijun Lin, The Woodlands, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 411 days.

(21) Appl. No.: 14/957,847

(22) Filed: Dec. 3, 2015

(65) Prior Publication Data

US 2016/0168919 A1 Jun. 16, 2016

Related U.S. Application Data

(60) Provisional application No. 62/090,063, filed on Dec. 10, 2014.

(51) Int. Cl.

| | |
|---|---|
| ***B24D 18/00*** | (2006.01) |
| ***E21B 10/56*** | (2006.01) |
| ***B24D 3/06*** | (2006.01) |

(52) U.S. Cl.

CPC ..... *B24D 18/0009* (2013.01); *B24D 3/06* (2013.01); *B24D 18/0018* (2013.01)

(58) Field of Classification Search

CPC ..... E21B 10/567; B24D 18/0009

See application file for complete search history.

(56) References Cited

U.S. PATENT DOCUMENTS 3,725,017 A * 4/1973 Prasse ..... B05B 7/226 420/580

5,326,195 A * 7/1994 Brox ..... B23B 51/00 407/118

(Continued)

FOREIGN PATENT DOCUMENTS

WO 2014081654 A1 5/2014

WO WO 2014/81654 * 5/2014 ..... C30B 25/00

OTHER PUBLICATIONS

First Office Action Issued Chinese Patent Application 201580075487.2 dated Sep. 4, 2018, 11 pages.

(Continued)

*Primary Examiner* — Pegah Parvini

(57) ABSTRACT

Methods for joining an ultra-hard body, such as a thermally stable polycrystalline diamond (TSP) body, to a substrate and mitigating the formation of high stress concentration regions between the ultra-hard body and the substrate. One method includes covering at least a portion of the ultra-hard body with an intermediate layer, placing the ultra-hard body and the intermediate layer in a mold, filling a remaining portion of mold with a substrate material including a matrix material and a binder material such that the intermediate layer is disposed between the ultra-hard body and the substrate material, and heating the mold to an infiltration temperature configured to melt the binder material and form the substrate.

18 Claims, 5 Drawing Sheets

(56) References Cited

U.S. PATENT DOCUMENTS

| | | | | |
|---|---|---|---|---|
| 5,472,058 | A * | 12/1995 | Hooper | E21B 10/25 175/371 |
| 2006/0254830 | A1* | 11/2006 | Radtke | E21B 10/5735 175/426 |
| 2006/0266558 | A1* | 11/2006 | Middlemiss | B22F 7/062 175/426 |
| 2006/0266559 | A1* | 11/2006 | Keshavan | B01J 3/062 175/428 |
| 2008/0024556 | A9* | 1/2008 | Silverbrook | B41J 2/14314 347/54 |
| 2008/0206576 | A1 | 8/2008 | Qian et al. | |
| 2008/0226870 | A1* | 9/2008 | Sypeck | B32B 5/26 428/137 |
| 2010/0194176 | A1* | 8/2010 | Lucek | E21C 35/183 299/29 |
| 2010/0282519 | A1 | 11/2010 | Zhang et al. | |
| 2010/0318064 | A1* | 12/2010 | Derrick | A61L 29/16 604/523 |
| 2012/0151848 | A1 | 6/2012 | Suryavanshi | |
| 2013/0264124 | A1* | 10/2013 | Belnap | B01J 3/06 175/428 |

OTHER PUBLICATIONS

International Search Report and Written Opinion issued in International Patent application PCT/US2015/063913 dated Feb. 19, 2016, 14 pages.

International Preliminary Report on Patentability issued in International Patent application PCT/US2015/063913, dated Jun. 13, 2017, 10 pages.

* cited by examiner

ULTRA-HARD MATERIAL CUTTING ELEMENTS AND METHODS OF MANUFACTURING THE SAME WITH A METAL-RICH INTERMEDIATE LAYER

CROSS-REFERENCE TO RELATED APPLICATION

The present application claims priority to U.S. Provisional Patent Application No. 62/090,063, filed on 10 Dec. 2014, which is incorporated by reference.

BACKGROUND

Cutting tools and rock drilling tools used during subterranean drilling operations, such as operations for drilling boreholes into the earth for the recovery of hydrocarbons (e.g., oil and natural gas), typically include a bit body and a plurality of cutting elements disposed on the bit body. These cutting elements commonly incorporate ultra-hard materials, such as polycrystalline diamond (PCD), due to their good wear resistance and hardness properties. Additionally, the PCD bodies are commonly bonded or otherwise coupled to substrates. The substrates facilitate attachment of the cutting elements to the bit body, such as by brazing.

PCD bodies are conventionally formed by sintering diamond particles mixed with a catalyst material, such as a metal catalyst selected from Group VIII of the periodic table, at high pressure and high temperature (HPHT). During the HPHT sintering process, the diamond particles form into an interconnected network of diamond crystals and the catalyst material infiltrates and occupies interstitial spaces or pores between the bonded diamond crystals. However, conventional PCD bodies are prone to thermal degradation because the catalyst material has a higher coefficient of thermal expansion than the diamond crystals. In particular, the thermal expansion differential between the catalyst and the diamond crystals and catalyst interstitially disposed between the diamond crystals can induce thermal stresses in the and the formation of cracks in the PCD body when the cutting element is subject to elevated temperatures, such as during a drilling operation. These thermal stresses may eventually result in the formation of cracks in the PCD body and the premature failure of the cutting element.

Accordingly, a variety of techniques have been developed to produce thermally stable PCD (TSP). Conventional processes for forming TSP bodies include using a non-metal catalyst during the HPHT sintering process of the diamond particles, HPHT sintering diamond particles without the use of a catalyst, or leaching a conventional PCD body with an acid to remove at least a portion of the catalyst material formed in the interstitial regions between the bonded diamond crystals.

Additionally, pre-formed TSP bodies may be joined to the substrates by placing the TSP body in a mold and then filling a remainder of the mold with a material configured to form the substrate when subject to elevated temperatures. The material configured to form the substrate typically includes a matrix material, such as tungsten or tungsten carbide, and a binder material, such as cobalt. When the mold is heated, the binder material is configured to infiltrate the matrix material and thereby bind the matrix particles together to form the substrate. Additionally, the binder material is configured to join the substrate to the TSP body by wetting the interface surface between the TSP body and the substrate and filling the pores between the diamond particles in the TSP body along the interface surface.

SUMMARY

The present disclosure is directed to various methods of joining an ultra-hard body to a substrate and mitigating the formation of high stress concentration regions between the ultra-hard body and the substrate. In one embodiment, the method includes covering at least a portion of the ultra-hard body with an intermediate layer, placing the ultra-hard body at least partially covered with the intermediate layer in a mold, filling a portion of mold with a substrate material and heating the substrate material to an infiltration temperature configured to form the substrate coupled to the ultra-hard body. The method may also include supporting the ultra-hard body on a displacement in the mold. The intermediate layer may be any suitable material, such as cobalt, nickel, copper, alloys thereof, or any combination thereof. The ultra-hard body may be any suitable type of thermally stable polycrystalline diamond (PCD), such as leached PCD, non-metal catalyst PCD, or catalyst-free PCD. The ultra-hard body may be a thermally stable polycrystalline cubic boron nitride (PCBN) body. The ultra-hard body may have a hardness greater than approximately 4000 kg/mm$^2$. The substrate material may be composed of a matrix material and a binder material.

A melting point of the intermediate layer may exceed the infiltration temperature such that the intermediate layer does not melt during the task of forming the substrate. A Young's modulus of the intermediate layer may be less than a Young's modulus of the TSP body and less than a Young's modulus of the substrate. Additionally, a hardness of the intermediate layer may be less than a hardness of the ultra-hard body and less than a hardness of the substrate.

Any suitable portions of the ultra-hard body may be covered by the intermediate layer. The method may include completely covering the ultra-hard body with the intermediate layer. The method may also include covering a first portion of the ultra-hard body with a first intermediate layer having a first thickness and covering a second portion of the ultra-hard body with a second intermediate layer having a second thickness different than the first thickness. In an embodiment in which the ultra-hard body is cylindrical and includes an outer surface, an inner surface opposite the outer surface, and a cylindrical sidewall extending between the outer and inner surfaces, the method may include covering at least a portion of each of the outer surface, the inner surface, and the cylindrical sidewall of the ultra-hard body with the intermediate layer. The intermediate layer may be discontinuous along the outer surface and/or the inner surface of the ultra-hard body.

The ultra-hard body may be covered with the intermediate layer by any suitable process. The method may include wrapping a thin metal strip around a portion of the ultra-hard body. The method may also include coating the ultra-hard body, such as by electroless plating, electroplating, vapor deposition, sputtering, spraying, or any combination thereof.

The present disclosure is also directed to various embodiments of an ultra-hard cutting element. In one embodiment, the ultra-hard cutting element includes an ultra-hard body, a substrate coupled to the ultra-hard body, and at least one intermediate layer between the ultra-hard body and the substrate and extending along at least a portion of an angled interface between the ultra-hard body and the substrate. The ultra-hard body may be cylindrical and include an outer surface, an inner surface opposite the outer surface, and a cylindrical sidewall extending between the outer and inner surfaces. The intermediate layer may cover at least a portion of each of the outer surface, the inner surface, and the cylindrical sidewall of the ultra-hard body. The substrate may cover at least a portion of each of the outer surface, the inner surface, and the cylindrical sidewall of the ultra-hard body. The intermediate layer may be discontinuous along at least one of the outer surface and the inner surface of the ultra-hard body. The intermediate layer may include a first intermediate layer having a first thickness and a second intermediate layer having a second thickness different than the first thickness.

A Young's modulus of the intermediate layer may be less than a Young's modulus of the ultra-hard body and less than a Young's modulus of the substrate. A hardness of the intermediate layer may be less than a hardness of the ultra-hard body and less than a hardness of the substrate. The intermediate layer may be any suitable material, such as cobalt, nickel, copper, alloys thereof, or any combination thereof. The ultra-hard body may be any suitable type of thermally stable polycrystalline diamond (PCD), such as leached PCD, non-metal catalyst PCD, or catalyst-free PCD. The intermediate layer may have any suitable thickness, such as from approximately 0.001 inch (25.4 μm) to approximately 0.005 inch (127 μm).

The present disclosure is also directed to methods of manufacturing a cutting element having an ultra-hard body coupled to a substrate. In one embodiment, the method includes placing the ultra-hard body in a mold, filling a portion of mold with a substrate material, heating the substrate material to an infiltration temperature configured to form the substrate and couple the substrate to the ultra-hard body, and removing graphitized regions of the ultra-hard body. The substrate material may be composed of a matrix material and a binder material having a liquefaction temperature of approximately 982° C. (approximately 1800° F.) or less. The infiltration temperature may be approximately 982° C. (approximately 1800° F.) or less or may be greater than approximately 982° C. (approximately 1800° F.). Removing the graphitized regions of the ultra-hard body may include removing a layer of the ultra-hard body having a depth from approximately 0.001 inch (25.4 μm) to approximately 0.03 inch (762 μm). Additionally, removing the graphitized regions of the ultra-hard body may include any suitable process, such as grinding, lapping, or a combination thereof. The ultra-hard body may be any suitable type of thermally stable polycrystalline diamond (PCD), such as leached PCD, non-metal catalyst PCD, or catalyst-free PCD.

This summary is provided to introduce a selection of concepts that are further described below in the detailed description. This summary is not intended to identify key or essential features of the claimed subject matter, nor is it intended to be used in limiting the scope of the claimed subject matter.

BRIEF DESCRIPTION OF THE DRAWINGS

These and other features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

The present disclosure is directed to various embodiments of an ultra-hard cutting element and methods of coupling an ultra-hard body (e.g., a thermally stable polycrystalline diamond body) to a substrate to form an ultra-hard cutting element. Embodiments of the present disclosure are also directed to various methods for mitigating the formation of high stress concentration regions between the ultra-hard body and the substrate during the process of coupling the ultra-hard body to the substrate. The ultra-hard cutting elements formed according to the methods of the present disclosure may be incorporated into any suitable industrial tools in which it is desirable to utilize the wear-resistance and hardness properties of the ultra-hard body, such as, for instance, in drill bits (e.g., fixed cutter bits or roller cone bits) or reamers for use in subterranean drilling or mining operations.

Figure 1:
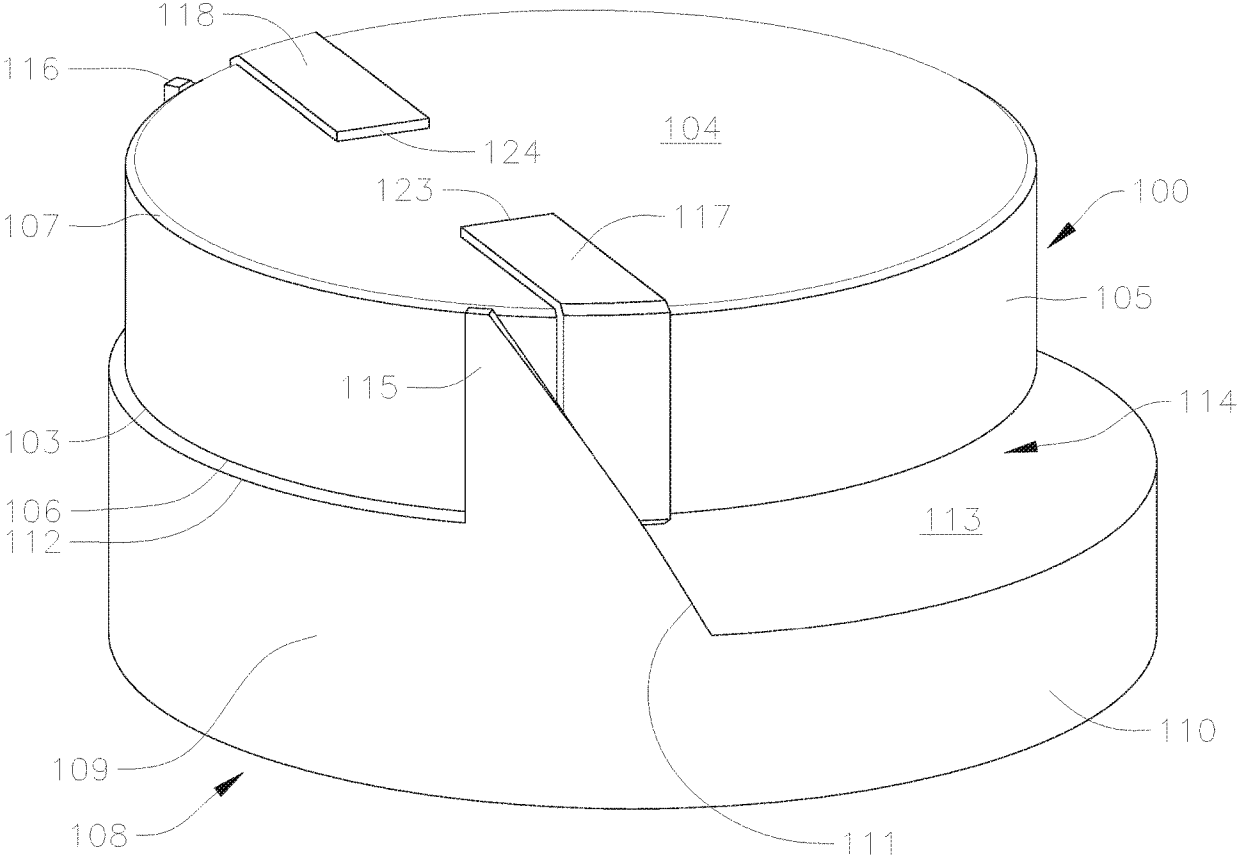
FIG. 1 a perspective view illustrating a task of supporting a thermally stable polycrystalline diamond (TSP) body on a displacement according to one embodiment of the present disclosure.
Figure 3:
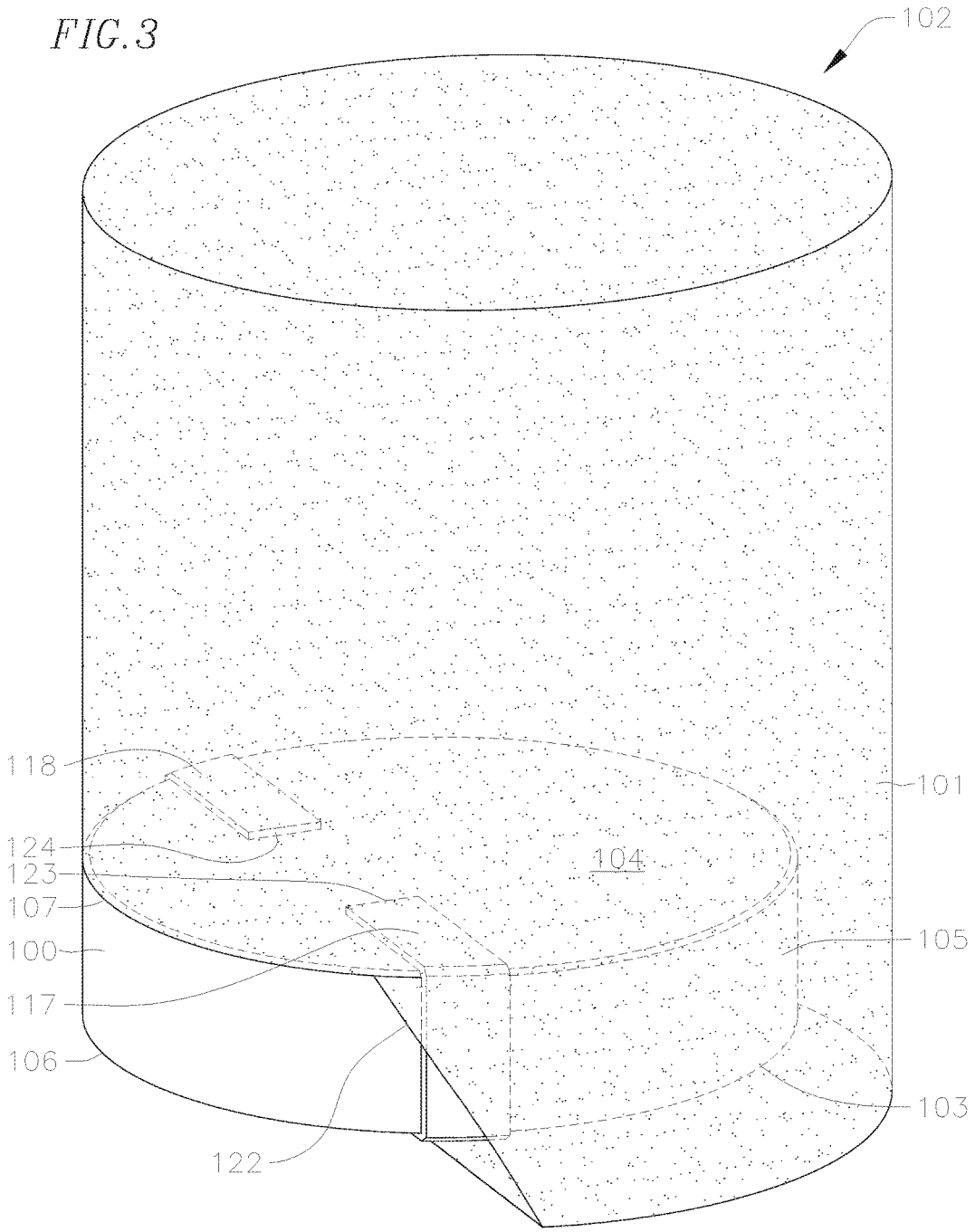
FIG. 3 is a perspective view of an ultra-hard cutting element formed according to one method of the present disclosure.

With reference now to FIGS. 1 and 3, a method of coupling a thermally stable polycrystalline diamond (TSP) body 100 to a substrate 101 to form an ultra-hard cutting element 102 according to one embodiment of the present disclosure will now be described. In one embodiment, the method includes forming the TSP body 100. The method may include forming any suitable type of TSP body 100, such as, for instance, a non-metal catalyst polycrystalline diamond (PCD), a binderless PCD, or a leached or partially leached PCD. In one embodiment, forming the non-metal catalyst-type of TSP body 100 comprises subjecting a diamond powder mixed with a non-metal catalyst (e.g., a thermally compatible silicon carbide or carbonate) to a high-pressure high-temperature (HPHT) sintering process, such as, for instance, applying a pressure of approximately 70 kbar or greater and a temperature from approximately 2,000° C. (approximately 3,632° F.) to approximately 2,500° C. (approximately 4,532° F.). In one embodiment, forming the binderless-type of TSP body 100 comprises subjecting carbon (e.g., graphite, buckyballs, or other carbon structures) without the presence of a catalyst material to an HPHT sintering process, such as, for instance, by applying a pressure from approximately 100-160 kbar and a temperature from approximately 1,800° C. (approximately 3,272° F.) to approximately 2,500° C. (approximately 4,532° F.). In one embodiment, forming the leached-type of TSP body 100 comprises subjecting a diamond powder mixed with a catalyst to an HPHT sintering process to form a conventional PCD body having an interconnected network of diamond crystals and the catalyst material occupying interstitial spaces or pores between the diamond crystals. Forming the leached-type of TSP body 100 also includes a task of treating the conventional PCD body to remove the catalyst material from the interstitial pores between the interconnected diamond crystals, such as by submerging the PCD body in an acid solution for a prerequisite period of time. In one or more alternate embodiments, the catalyst material occupying the pores between the diamond crystals may be removed by any other suitable process, such as, for instance, thermal decomposition.

In an alternate embodiment, the method may include obtaining or providing a pre-formed TSP body 100 of any of the types described above. Additionally, in an alternate embodiment, the method may include forming a thermally stable polycrystalline cubic boron nitride (PCBN) body or obtaining or providing a pre-formed PCBN body rather than a TSP body 100. Additionally, in one embodiment, the method may include forming, obtaining, or providing any other suitable type or kind of ultra-hard body other than a TSP or PCBN body. For instance, in one embodiment, the ultra-hard body may be formed from any suitable material or materials having a hardness exceeding approximately 4000 $kg/mm^2$. Additionally, in one embodiment, the method may include forming or obtaining a TSP body 100 where only a portion of the TSP body is thermally stable. For instance, the catalyst may be removed from only a portion of the PCD body (e.g., by leaching or thermal decomposition) and the remainder of the PCD body may be conventional PCD. As used herein, the term "ultra-hard" is understood to refer to those materials known in the art to have a grain hardness of about 4,000 Vickers Pyramid Number (HV) or greater. Such ultra-hard materials may include those capable of demonstrating physical stability at temperatures above about 750° C. (approximately 1382° F.), and for certain applications above about 1,000° C. (approximately 1832° F.), that are formed from consolidated materials. Such ultra-hard materials may include, but are not limited to, diamond, cubic boron nitride (cBN), diamond-like carbon, boron suboxide, aluminum manganese boride, and other materials in the boron-nitrogen-carbon phase diagram which have shown hardness values above 4,000 HV.

In the example embodiment illustrated in FIG. 1, the TSP body 100 is cylindrical and includes an outer, working surface 103, an inner, interface surface 104 opposite the working surface 103, a cylindrical sidewall 105 extending between the working surface 103 and the interface surface 104, a cutting edge 106 defined where the cylindrical sidewall 105 meets the working surface 103, and an interface edge 107 defined where the cylindrical sidewall 105 meets the interface surface 104. The cutting edge 106 is the portion of the TSP body 100 that is configured to engage an earthen formation during a subterranean drilling or mining operation when the ultra-hard cutting element 102 into which the TSP body 100 is incorporated on a drill bit. The interface surface 104 is the portion of the TSP body 100 that abuts the substrate 101 when the TSP body 100 is coupled to the substrate 101 to form the ultra-hard cutting element 102, as shown, for example, in FIG. 3. Although the TSP body 100 in the illustrated embodiment is cylindrical, in one or more alternate embodiments, the TSP body 100 may have any other suitable shape depending upon the intended application of the ultra-hard cutting element 102 into which the TSP body 100 is incorporated. Additionally, although the TSP body 100 in the illustrated embodiment includes a planar interface surface 104, in one or more alternate embodiments, the interface surface 104 of the TSP body 100 may be non-planar. For instance, the interface surface 104 of the TSP body 100 may include one or more features configured to join the TSP body 100 to the substrate 101, such as, for instance, depressions (e.g., grooves or channels) or projections (e.g., ribs) configured to engage complementary features on the substrate 101.

With continued reference to the embodiment illustrated in FIG. 1, the method also includes a task of supporting the TSP body 100 on a displacement 108. The displacement 108 is configured to prevent the substrate 101 from forming around those portions of the TSP body 100 that contact the displacement 108 (e.g., the portions of the TSP body 100 that contact the displacement 108 remain exposed after coupling the TSP body 100 to the substrate 101). In the illustrated embodiment, the displacement 108 is a cylindrical disc having a thicker region 109, a thinner region 110, and a step 111 defined between the thicker and thinner regions 109, 110. An inner surface 112 of the thicker region 109 is configured to support at least a portion of the outer, working surface 103 of the TSP body 100. An inner surface 113 of the thinner region 110 is configured to be spaced apart from the outer, working surface 103 of the TSP body 100 such that a gap or cavity 114 is formed between the outer, working surface 103 of the TSP body 100 and the thinner region 110 of the displacement 108. The displacement 108 also includes a pair of opposing triangular projections 115, 116 extending beyond the thicker region 109. The triangular projections 115, 116 are configured to abut the cylindrical sidewall 105 of the TSP body 100.

As described in more detail below, the substrate 101 is formed and coupled to the TSP body 100 by filling a mold 120 containing the TSP body 100 with a substrate material 121. As illustrated FIG. 2, the displacement 108 is configured to prevent the substrate 101 from forming around the portion of the outer, working surface 103 of the TSP body 100 that is in contact with the inner surface 112 of the thicker region 109 of the displacement 108. The displacement 108 is also configured to prevent the substrate 101 from forming around the portion of the cylindrical sidewall 105 of the TSP body 100 that is supported on the thicker region 109 of the displacement 108 and that extends between the triangular projections 115, 116 of the displacement 108. Accordingly, as illustrated in FIG. 3, a portion of the cutting edge 106 of the TSP body 100 remains exposed after the TSP body 100 is joined to the substrate 101. Additionally, as illustrated in FIGS. 1 and 3, the triangular projections 115, 116 of the displacement 108 are configured to define an angled edge or interface 122 between the substrate 101 and the cylindrical sidewall 105 of the TSP body 100. The displacement 108 may have any other suitable shape depending on the desired exposed regions of the TSP body 100 and the intended application of the ultra-hard cutting element 102 incorporating the TSP body 100.

With continued reference to FIG. 1, the method also includes a task of covering at least a portion of the TSP body 100 with one or more intermediate layers. In the illustrated embodiment, the TSP body 100 is covered with two intermediate layers 117, 118, although in one or more alternate embodiments, portions of the TSP body 100 may be covered by any other suitable number of intermediate layers, such as, for instance, from one to ten intermediate layers. As described in more detail below, the intermediate layers 117, 118 are configured to mitigate the formation of stress concentration regions between the TSP body 100 and the substrate 101, which would otherwise develop during the process of joining the TSP body 100 to the substrate 101 due to the coefficient of thermal expansion differential between the diamond crystals in the TSP body 100 and the matrix material in the substrate 101. In one embodiment, the intermediate layers 117, 118 are also configured to increase the toughness of the ultra-hard cutting element 102 and the cutting dynamics of the ultra-hard cutting element 102 during a drilling or mining operation. The task of covering at least a portion of the TSP body 100 with the intermediate layers 117, 118 may be performed by any suitable process, such as, for instance, wrapping one or more thin metal strips (e.g., foil) around the TSP body 100, electroplating, electroless plating, vapor deposition (e.g., chemical vapor deposition or physical vapor deposition), sputtering, spraying, or any combination thereof. Additionally, the task of covering at least a portion of the TSP body 100 with the intermediate layers 117, 118 may be performed before the task of supporting the TSP body 100 on the displacement 108.

In general, higher stress concentrations generally develop where the contact area between the substrate 101 and the TSP body 100 is irregular, contains a relatively sharp angle (e.g. an edge or a corner), or contains complex geometry. Accordingly, in one embodiment, the method may include covering with the one or more intermediate layers 117, 118 only those portions of the TSP body 100 on which high stress concentrations are likely to develop based on the geometry of the contact area between the TSP body 100 and the substrate 101. Additionally, the method may include covering only those portions of the TSP body 100 that are likely to experience stress concentrations exceeding a threshold value, such as, for instance, stress concentrations sufficiently high that they may precipitate the formation of cracks or otherwise damage the structural integrity of at least one of the TSP body 100, the substrate 101, or ultra-hard cutting element 102. In one or more alternate embodiments, any other suitable portion or portions of the TSP body 100 may be covered by the one or more intermediate layers 117, 118.

In the embodiment illustrated in FIG. 1, the intermediate layers 117, 118 are two thin metal strips (e.g., foil) and the method includes wrapping the metal strip intermediate layers 117, 118 around portions of the cylindrical sidewall 105 of the TSP body 100 that are proximate to the triangular projections 115, 116 on the displacement 108. The metal strip intermediate layers 117, 118 on the TSP body 100 may be located proximate to the triangular projections 115, 116 on the displacement 108 because the triangular projections 115, 116 are configured to define the angled edges or interfaces 122 between the substrate 101 and the TSP body 100 (see FIG. 3) and high stress concentrations may develop in these angled interfaces 122 during the process of joining the TSP body 100 to the substrate 101 and/or during use of the ultra-hard cutting element 102 in a drilling operation.

Additionally, in the illustrated embodiment of FIG. 1, the metal strip intermediate layers 117, 118 are wrapped around the interface edge 107 and the cutting edge 106 and onto the interface surface 104 and the working surface 103, respectively, of the TSP body 100. The intermediate layers 117, 118 may be wrapped around the edges 106, 107 of the TSP body 100 because the edges 106, 107 define relatively sharp angles in which high stress concentrations may develop during the process of joining the TSP body 100 to the substrate 101 and/or during use of the ultra-hard cutting element 102 in a drilling operation. Further, in the illustrated embodiment, ends 123, 124 of the metal strip intermediate layers 117, 118, respectively, are spaced apart along the inner, interface surface 104 and the outer, working surface 103 of the TSP body 100 (i.e., the intermediate layers 117, 118 are discontinuous along the inner, interface surface 104 and the outer, working surface 103 of the TSP body 100). The ends 123, 124 of the metal strip intermediate layers 117, 118 may be spaced apart along the outer and inner surfaces 103, 104 of the TSP body 100 because, in the illustrated embodiment, these surfaces 103, 104 define flat interfaces between the TSP body 100 and the substrate 101 and therefore these regions of the TSP body 100 may experience relatively lower stresses compared to the stresses developed along the more complex geometric regions of the TSP body 100 (e.g., the cylindrical sidewall 105, the cutting edge 106, and the interface edge 107). The intermediate layers 117, 118 may have any suitable thickness, such as, for instance, from approximately 0.001 inch (25.4 μm) to approximately 0.005 inch (127 μm). In one embodiment, the intermediate layers 117, 118 may have a thickness from approximately 0.002 inch to approximately 0.003 inch, such as, for instance, approximately 0.0025 inch.

Although in the illustrated embodiment the method includes wrapping the metal strip intermediate layers 117, 118 around the TSP body 100, in one or more alternate embodiment, the intermediate layers may be applied to the TSP body 100 by any other suitable process. For instance, in one embodiment, the method may include masking off portions of the TSP body 100 and then depositing the one or more intermediate layers 117, 118 onto the unmasked portions of the TSP body 100, such as by electroplating, electroless plating, vapor deposition, sputtering, spraying, or dipping. In another embodiment, the method may include wrapping a single, continuous metal strip (e.g., foil) continuously and completely around the TSP body 100 (i.e., the intermediate layer may be a thin metal strip that is not discontinuous along the flat outer and inner surfaces 103, 104 of the TSP body 100). In a further embodiment, the method may include covering with the intermediate layer the entire portion of the TSP body 100 that will contact with the substrate 101. In another embodiment, the one or more intermediate layers may completely cover the entire TSP body 100.

With continued reference to FIG. 1, the method may also include a task of covering the TSP body 100 with one or more relatively thicker intermediate layers and one or more relatively thinner intermediate layers depending on the anticipated stress concentrations that will develop between the TSP body 100 and the substrate 101 during the task of joining the TSP body 100 to the substrate 101 (e.g., the method may include covering the TSP body 100 with two or more intermediate layers having different thicknesses). In general, thicker intermediate layers are configured to mitigate the formation of higher stress concentration levels than relatively thinner intermediate layers. For instance, in one embodiment, the task may include covering a portion of the TSP body 100 with one or more thin metal strips having a first thickness and covering a different portion of the TSP body 100 with one or more thin metal strips having a second thickness greater than the first thickness. For instance, in one embodiment, the one or more thicker intermediate layers may have a thickness from approximately 0.003 inch to approximately 0.005 inch (127 μm) and the one or more thinner intermediate layers may have a thickness from approximately 0.001 inch (25.4 μm) to approximately 0.003 inch.

In one embodiment, the one or more thicker intermediate layers may be provided along the sharper or more complex geometry of the TSP body 100 (e.g., the cylindrical sidewall 105, the cutting edge 106, and/or the interface edge 107) and the one or more thinner intermediate layers may be provided along the flatter geometry of the TSP body 100 (e.g., the outer, working surface 103 and/or the inner, interface surface 104). In an embodiment in which the intermediate layers are deposited onto the TSP body 100 (e.g., by physical vapor deposition), the method may include a task of depositing a first intermediate layer having a first thickness onto at least a portion of the TSP body 100, masking off regions of the first intermediate layer and/or uncoated regions of the TSP body 100, and then performing a second deposition to form a second intermediate layer having a second thickness greater than the first thickness of the first intermediate layer (e.g., the unmasked regions of the TSP body 100 during the second deposition will be covered in a thicker intermediate layer than the regions of the TSP body 100 covered with the first intermediate layer during the first deposition). Although the method has been described above with reference to only two different intermediate layers, in one or more alternate embodiments, the method may include covering portions of the TSP body 100 with any other suitable number of different intermediate layers, such as, for instance, from three to ten different intermediate layers, depending on the number of different stress concentration levels the TSP body 100 is expected to experience during the process of joining the TSP body 100 to the substrate 101.

Figure 2:
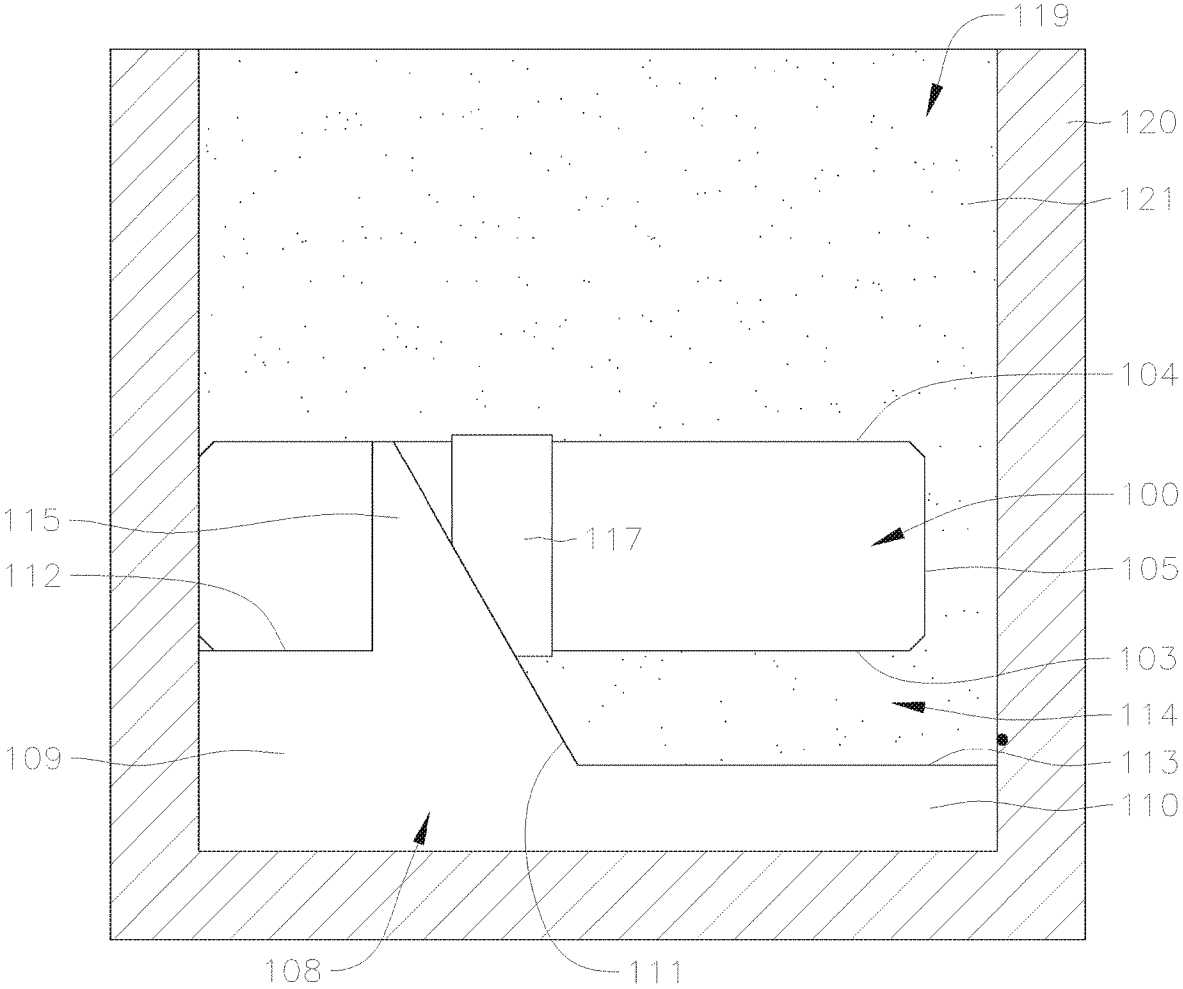
FIG. 2 is a cross-sectional view illustrating a task of inserting the TSP body and the displacement of FIG. 1 into a mold and a task of filling the mold with a substrate material according to one embodiment of the present disclosure.

With reference now to FIG. 2, the method also includes a task of placing the displacement 108 and the TSP body 108 at least partially covered with the one or more intermediate layers 117, 118 into a cavity 119 defined by a mold 120. In an alternate embodiment, the method may include a task of first placing the displacement 108 into the cavity 119 of the mold 120 and then placing the TSP body 100 at least partially covered with the intermediate layers 117, 118 into the cavity 119 of the mold 120 and onto the displacement 108. In another alternate embodiment, features of the displacement 108 may be integrally formed in the cavity 119 of the mold 120 such that a separate displacement 108 may not be used according to one method of joining the TSP body 100 to the substrate 101. Furthermore, in one embodiment, the method may include temporarily attaching the TSP body 100 to the displacement 108 before inserting the TSP body 100 and the displacement 108 into the cavity 119 of the mold 120 together. Temporarily attaching the TSP body 100 to the displacement 108 is configured to maintain the proper alignment between the TSP body 100 and the displacement 108 during a subsequent task of joining the TSP body 100 to the substrate 101. The TSP body 100 may be temporarily attached to the displacement 108 by any suitable process, such as, for instance, with removable adhesive.

With continued reference to FIG. 2, the method also includes a task of filling a remainder of the cavity 119 with a substrate material 121 configured to form the substrate 101. In one embodiment, the substrate material 121 is composed of a matrix powder (e.g., tungsten carbide (WC) powder or tungsten (W) powder) and a binder material. In one embodiment, the binder material may be any suitable metal, such as, for instance, iron, cobalt, nickel, copper, manganese, zinc, tin, alloys thereof (e.g., nickel alloy), or any suitable combination thereof. The metal binder material may be provided either as a separate powder or as a solid body (e.g., a disc of binder material) placed on top of the matrix powder. In another embodiment, the metal binder powder may be intermixed with the matrix powder. Additionally, in one or more embodiments, the method may include a task of mixing an organic solvent (e.g., alcohol) with the metal binder powder and the matrix powder to form a slurry or a paste. Mixing the organic solvent into the matrix powder and the binder powder may facilitate ease of handling the substrate material 121 during the task of filling the cavity 119 of the mold 120 with the substrate material 121. The organic solvent may be selected such that is does not affect the chemical characteristics of the matrix material.

In one embodiment, the method also includes a task of tightly packing the substrate material 121 in the cavity 119 of the mold 120 by any suitable process, such as, for instance, shaking the mold 120 to settle the substrate material 121 in the cavity 119 and/or pressing the substrate material 121 into the cavity 119 of the mold 120. In the illustrated embodiment, when the substrate material 121 is tightly packed into the cavity 119 of the mold 120, the substrate material enters and fills the gap 114 defined between the outer, working surface 103 of the TSP body 100 and the inner surface 113 of the thinner region 110 of the displacement 108, surrounds the portion of the cylindrical sidewall 105 of the TSP body 100 extending between the triangular projections 115, 116 of the displacement 108, and forms a cylindrical column above the inner, interface surface 104 of the TSP body 100. In an alternate embodiment, the method may include a task of filling the gap 114 defined between the working surface 103 of the TSP body 100 and the inner surface 113 of the thinner region 110 of the displacement 108 with a first substrate material and then filling a remainder of the cavity 119 with a second substrate material different than the first substrate material. In one embodiment, the first substrate material may be selected to have a lower coefficient of thermal expansion than the second substrate material to mitigate the formation of stress concentration regions between the substrate 101 and the TSP body 100. Additionally, in one embodiment, the substrate material 121 may be pre-packed into the gap 114 defined between the working surface 103 of the TSP body 100 and the inner surface 113 of the thinner region 110 of the displacement 108 before inserting the TSP body 100 into the cavity 119 of the mold 120 and then a remainder of substrate material 121 may be packed into the cavity 119 of the mold 120 after the TSP body 100 is inserted into the mold 120.

Still referring to FIG. 2, the method also includes a task of closing the cavity 119 of the mold 120 and heating the mold 120 and the substrate material 121 in the cavity 119 to a temperature equal to or exceeding the melting point of the binder material (i.e., the infiltration temperature of the binder material). In one embodiment, the task of heating the mold 120 includes placing the mold 120 in a furnace generating a temperature of approximately 1204° C. (approximately 2200° F.), although the furnace may be configured to generate any other suitable temperature depending on the melting point of the selected metal binder material. For instance, in one embodiment, the task may include placing the mold 120 in a furnace generating a temperature of approximately 982° C. (approximately 1800° F.) or less. The method may also include a task of heating the mold 120 at or above the infiltration temperature of the binder material for a sufficient duration to cause the liquefied binder material to sufficiently infiltrate into the matrix material. The liquefied binder material may be drawn through the matrix material due to capillary action. In an embodiment in which the matrix material and the binder material are mixed with an organic solvent to form a slurry, the organic solvent is configured to burn off during the task of heating the mold 120.

In one embodiment, the coefficient of thermal expansion of the matrix material in the substrate 121 is higher than the coefficient of thermal expansion of the diamond crystals in the TSP body 100. For instance, in one embodiment, the matrix material has a coefficient of thermal expansion of approximately $5^{-5}$/K and the diamond crystals in the TSP body 100 have a coefficient of thermal expansion of approximately $2^{-6}$/K. Accordingly, during the task of heating the mold 120, the matrix material contracts or shrinks at a faster rate than the TSP body 100. This differential rate of contraction between the substrate 101 and the TSP body 100 would typically tend to generate regions of high stress concentration between the substrate 101 and the TSP body 100, particularly where the contact area between the substrate 101 and the TSP body 100 is irregular, contains a relatively sharp angle (e.g. an edge or a corner), or contains complex geometry. However, the one or more intermediate layers 117, 118 located between the TSP body 100 and the substrate 101 are configured to plastically deform and thereby prevent or mitigate the formation of hard contact points between the TSP body 100 and the substrate 101 that generate such high stress concentrations (i.e., the one or more intermediate layers 117, 118 are configured to plastically deform in response to the differential rate of contraction between the substrate 101 and the TSP body 100 and thereby mitigate the formation of regions of high stress concentration between the substrate 101 and the TSP body 100). Accordingly, the intermediate layers 117, 118 are configured to function as buffer layers that deform to prevent hard contact regions between the TSP body 100 and the substrate 101.

The method also includes a task of cooling the mold 120 at a temperature below the infiltration temperature of the binder material (e.g., at room temperature) until the binder material solidifies and thereby binds the matrix particles together to form a solid body matrix in the desired size and shape of the substrate 101. Additionally, during the task of cooling the mold 120, the solidified substrate 101 is mechanically joined to the TSP body 100 (i.e., the substrate 101 is configured to mechanically lock or interlock the TSP body 100 in place).

FIG. 3 illustrates the ultra-hard cutting element 102 formed according to methods of the present disclosure. The ultra-hard cutting element 102 includes the TSP body 100 mechanically joined to the substrate 101 and the intermediate layers 117, 118 disposed between the TSP body 100 and the substrate 101. In the illustrated embodiment, the substrate 101 extends from the interface surface 104 of the TSP body 100, around a portion of the cylindrical sidewall 105 of the TSP body 100, and covers a portion of the outer, working surface 103 of the TSP body 100. In this manner, the substrate 101 clamps onto the TSP body 100 to mechanically join the TSP body 100 to the substrate 101.

The one or more intermediate layers 117, 118 may be formed from any suitably hard and durable material, such as, for instance, a Group I metal (e.g., copper), a Group VIII metal (e.g., iron, cobalt, nickel), a Group IX metal, a Group X metal, a metal alloy (e.g., nickel alloy), or any combination thereof. In one embodiment, the materials of the one or more intermediate layers 117, 118 may be selected such that the Young's Modulus ($E_{IL}$) of the one or more intermediate layers 117, 118 is lower than the Young's Modulus $E_{TSP}$, $E_S$ of the TSP body 100 and the substrate 100, respectively. For instance, in one embodiment, the Young's modulus $E_{TSP}$ of the TSP body 100 is approximately 1200 GPA and cobalt may be selected as the material of the one or more intermediate layers 117, 118 such that the Young's modulus $E_{IL}$ of the one or more intermediate layers 117, 118 is approximately 209 GPa at room temperature. In one embodiment, the one or more intermediate layers 117, 118 may have two or more different Young's Moduli. For instance, one or more portions of the intermediate layers 117, 118 in contact with the substrate 101 may have a higher Young's Modulus than one or more portions of the intermediate layers 117, 118 that are not in contact with the substrate 101 (e.g., the portions of the intermediate layers 117, 118 in contact with the substrate 101 may have a higher Young's Modulus than the portions of the intermediate layers 117, 118 that are only in contact with the TSP body 100). In one embodiment, the two different Young's Moduli of the intermediate layers 117, 118 may each be lower than the Young's Modulus $E_{TSP}$, $E_S$ of the TSP body 100 and the substrate 100, respectively. Additionally, the Young's modulus $E_{IL}$ of the one or more intermediate layers 117, 118 will decrease during the task of heating the mold 120 to form the substrate 101.

In one embodiment, portions of each of the intermediate layers 117, 118 extending along the sharper or more complex geometry of the TSP body 100 (e.g., the cylindrical sidewall 105, the cutting edge 106, and/or the interface edge 107) are thicker than the portions of the intermediate layers 117, 118 extending along the flatter geometry of the TSP body 100 (e.g., the outer, working surface 103 and/or the inner, interface surface 104). As described above, in general, thicker portions of the intermediate layers 117, 118 are configured to mitigate the formation of higher stress concentration levels than relatively thinner portions of the intermediate layers 117, 118. In one embodiment, the one or more thicker portions of the intermediate layers 117, 118 may have a thickness from approximately 0.003 inch to approximately 0.005 inch (127 μm) and the one or more thinner portions of the intermediate layers 117, 118 may have a thickness from approximately 0.001 inch (25.4 μm) to approximately 0.003 inch.

Further, in one embodiment, the materials of the one or more intermediate layers 117, 118 may be selected such that the one or more intermediate layers 117, 118 each have a hardness less than the TSP body 100 and the substrate 101. For instance, in one embodiment, the intermediate layers 117, 118 may have a hardness from approximately 500 $kg/mm^2$ to approximately 1000 $kg/mm^2$. Accordingly, due to the relatively lower hardness and Young's modulus of the one or more intermediate layers 117, 118, the one or more intermediate layers 117, 118 are each configured to deform during the task of heating the mold 120 to join the TSP body 100 to the substrate 101. The deformation of the intermediate layers 117, 118 is configured to prevent the formation of hard contact points or regions between the TSP body 100 and the substrate 101 and thereby mitigate the development of high stress concentration regions between the TSP body 100 and the substrate 101. Additionally, the one or more intermediate layers 117, 118 may also be configured to plastically deform during a drilling or mining operation to mitigate the formation of high stress concentration regions which might otherwise develop between the TSP body 101 and the substrate 100 during the drilling or mining operation.

In one embodiment, the material of the one or more intermediate layers 117, 118 may be selected such that the melting point of the one or more intermediate layers 117, 118 exceeds the infiltration temperature of the binder material and the temperature to which the mold 120 is heated during the task of forming the substrate 101 and joining the TSP body 100 to the substrate 101. For instance, in one embodiment, cobalt may be selected as the material of the one or more intermediate layers 117, 118 such that the melting temperature of the one or more intermediate layers 117, 118 is approximately 1495° C. (approximately 2723° F.). Accordingly, in one embodiment, the one or more intermediate layers 117, 118 will not melt during the task of heating the mold 120, which enables the one or more intermediate layers 117, 118 to plastically deform and thereby mitigate the formation of regions of high stress concentration between the TSP body 100 and the substrate 101, as described above. In an alternate embodiment, the material of intermediate layers 117, 118 may be selected such that the intermediate layers 117, 118 melt during the task of heating the mold 120. Additionally, in one or more embodiments, the intermediate layers 117, 118 may react with the substrate material 121 during the task of heating the mold 120 and form an alloy that has a melting point lower than the infiltration temperature of the binder material. Accordingly, in one embodiment, the intermediate layers 117, 118 may melt during the task of heating the mold 120 due to the reaction between the intermediate layers 117, 118 and the substrate material 121.

In one embodiment, the task of heating the mold 120 and the substrate material 121 in the cavity 119 to a temperature equal to or exceeding the melting point of the binder material may cause a portion of the TSP body 100 to graphitize (i.e., the diamond crystals in the TSP body 100 may graphitize under the elevated temperature used to form the substrate 101). In general, graphitization is a form of thermal degradation that adversely affects the performance characteristics of the TSP body 100 (e.g., graphitization may reduce the wear durability of the TSP body 100 in a cutting operation). Accordingly, in one embodiment, the method may include a task of finishing or post-processing the TSP body 100 to remove the graphitized regions of the TSP body 100, thereby improving the performance characteristics of the TSP body 100. The task of removing the graphitized portion of the TSP body 100 may be performed by any suitable process, such as, for instance, grinding, lapping, or a combination thereof.

In one embodiment, the graphitized regions of TSP body 100 may be localized along the outer, working surface 103 and the cylindrical sidewall 105 of the TSP body 100. The depth of the graphitized regions of the TSP body 100 may vary depending on the temperature used to form the substrate 101 and join the substrate 101 to the TSP body 100. In general, higher temperatures result in the graphitized regions having a greater depth. In one embodiment, the graphitized regions of the TSP body 100 may have a depth ranging from approximately 0.001 inch (25.4 μm) to approximately 0.03 inch (762 μm). Accordingly, in one embodiment, the task of post-processing the TSP body 100 to remove the graphitized regions may include removing approximately 0.001 inch (25.4 μm) to approximately 0.03 inch (762 μm) from the outer working surface 103 and the cylindrical sidewall 105 of the TSP body 100. In one or more alternate embodiments, the method may include post-processing the TSP body 100 to remove any other suitable depth of material from the outer working surface 103 and the cylindrical sidewall 105 of the TSP body 100, such as, for instance, a depth of material greater than 0.03 inch (762 μm).

Additionally, in one embodiment, the graphitized regions of the TSP body 100 are electrically conductive and the non-graphitized regions of the TSP body 100 are not electrically conductive. Accordingly, in one embodiment, the method may include a task of removing portions of the TSP body 100 until the TSP body 100 is no longer electrically conductive (e.g., the method may include successively removing a portion of the TSP body 100 and measuring the electrical conductivity of the TSP body 100 until the electrically conductive graphitized regions of the TSP body 100 are completely or substantially completely removed).

Figure 4:
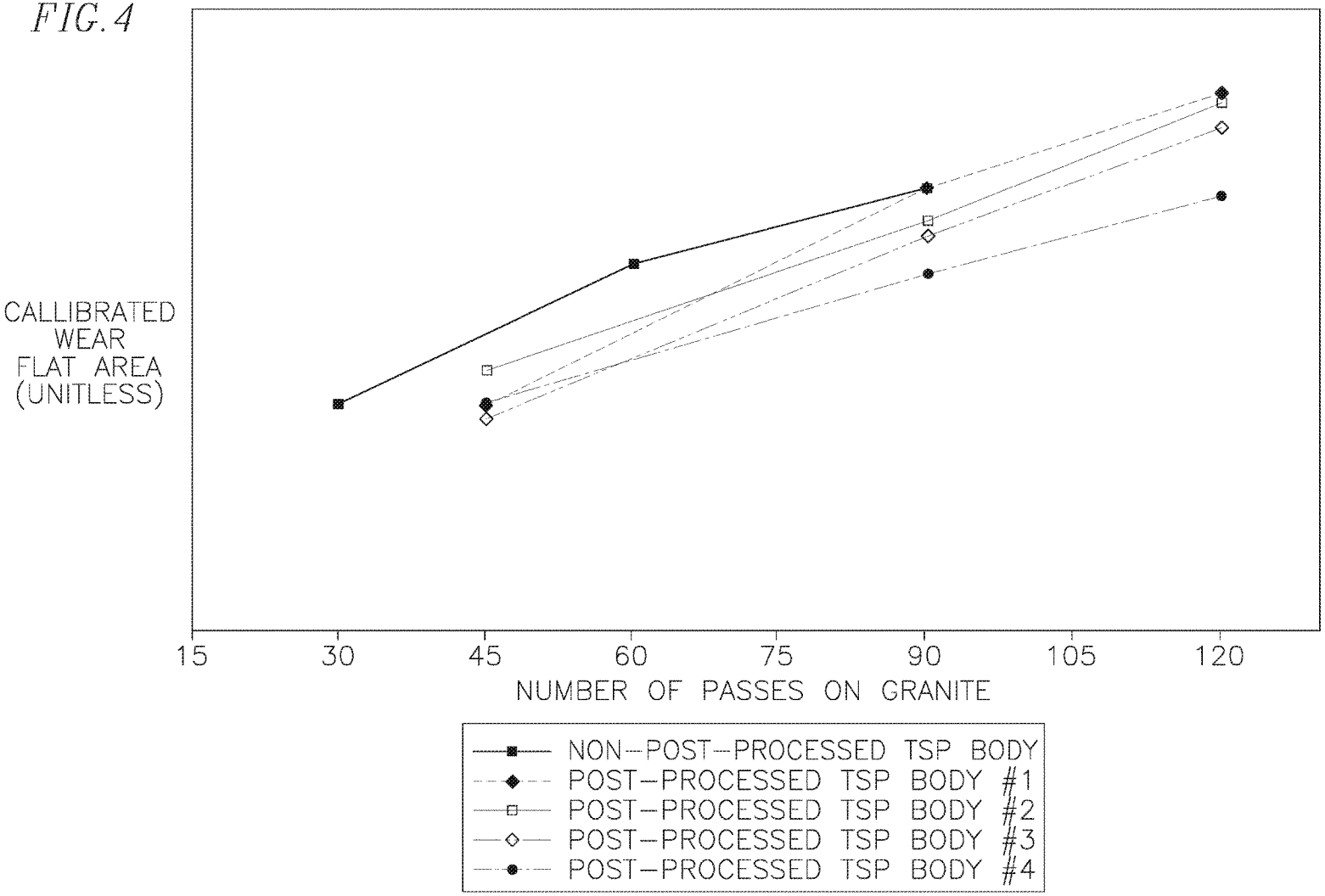
FIG. 4 is graph depicting the performance results of five different TSP bodies in a vertical turret lathe (VTL) test.

The graph in FIG. 4 depicts the performance results of five different TSP bodies in a vertical turret lathe (VTL) test. Four of the TSP bodies tested were post-processed to remove all or substantially all of the graphitized regions prior to conducting the VTL test and one of the TSP bodies was not post-processed to remove the graphitized regions of the TSP body. As illustrated in FIG. 4, the TSP body that was not post-processed to remove the graphitized regions of the TSP body failed after 90 passes on the VTL test whereas each of the TSP bodies that were post-processed to remove the graphitized regions of the TSP body survived 120 passes on the VTL test.

Additionally, in one embodiment, the method may include a task of selecting a binder material having a melting point (i.e., a liquefaction temperature) lower than conventional binder materials (i.e., the method may include selecting a binder material that is configured to melt and infiltrate the matrix material at a lower temperature than conventional binder materials). Lowering the liquefaction temperature of the binder material facilitates lowering the temperature of the heat source (e.g., the furnace) that is applied to the mold 120 to form and join the substrate 101 to the TSP body 100. In general, lowering the temperature of the heat source used to form and join the substrate 101 to the TSP body 100 reduces the depth of the regions of the TSP body 100 that graphitize (i.e., lowering the temperature applied to the mold 120 to form and join the substrate 101 to the TSP body 100 reduces the thermal degradation of the TSP body 100). In one embodiment, the method may include selecting a binder material that has a melting point (i.e., a liquefaction temperature) of approximately 982° C. (approximately 1800° F.) or less. In another embodiment, the method may include selecting a binder material that has a melting point of approximately 816° C. (approximately 1500° F.) or less. For instance, in one embodiment, the method includes selecting a low temperature binder composed of zinc (Zn) and tin (Sn) having a sum weight % of about 26.5% to about 30.5% in which Zn is at least about 12% and Sn is at least about 6.5%, nickel (Ni) at about 4.5 to about 6.5 weight %, manganese (Mn) at about 11 to about 26 weight %, and copper (Cu) at about 40 to about 55 weight %.

Figure 5:
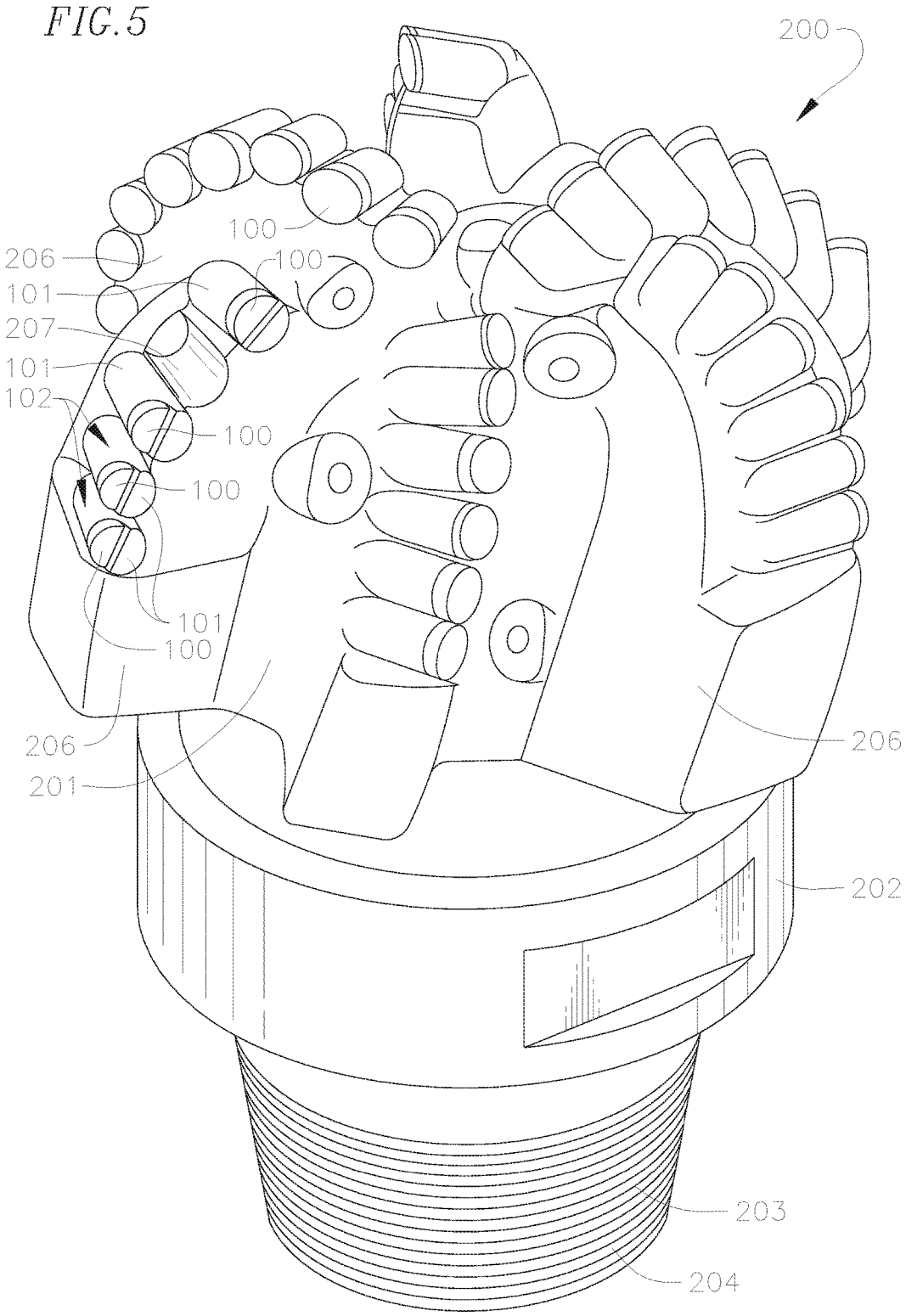
FIG. 5 is a perspective view of a drill bit incorporating ultra-hard cutting elements formed according to one method of the present disclosure.

The ultra-hard cutting elements 102 formed according to the methods of the present disclosure may be incorporated into any suitable industrial tools in which it is desirable to utilize the wear-resistance and hardness properties of the TSP body 100, such as, for instance, in drill bits (e.g., fixed cutter bits or roller cone bits) or reamers for use in subterranean drilling or mining operations. For instance, in the embodiment illustrated in FIG. 5, a drag bit 200 includes a bit body 201, a cylindrical shank 202 extending from one end of the bit body 201, and a tapered pin 203 extending from a side of the cylindrical shank 202 opposite the bit body 201. The tapered pin 203 includes external threads 204 for coupling the drill bit 200 to a drill string assembly configured to rotatably advance the drill bit 200 into a subterranean formation to form a borehole. The drill bit 200 also includes a plurality of blades 206 circumferentially disposed around the bit body 201. Each of the blades 206 defines a plurality of cutter pockets 207. The cutter pockets 207 are configured to receive and support the ultra-hard cutting elements 102 formed according to the methods of the present disclosure. One of the ultra-hard cutting elements 102 is omitted in FIG. 5 to reveal one of the cutter pockets 207. The ultra-hard cutting elements 102 may be secured in the cutter pockets 207 by any suitable process, such as, for instance, by brazing the substrates 101 of the ultra-hard cutting elements 102 to the blades 206.

While this invention has been described in detail with particular references to embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention. Additionally, as used herein, the term "substantially" and similar terms are used as terms of approximation and not as terms of degree, and are intended to account for the inherent deviations in measured or calculated values that would be recognized by those of ordinary skill in the art. Furthermore, as used herein, when a component is referred to as being "on" or "coupled to" another component, it can be directly on or attached to the other component or intervening components may be present therebetween.

What is claimed is:

1. A method, comprising:

covering at least a portion of an ultra-hard body with an intermediate layer, the ultra-hard body comprising an outer surface, an inner surface and a sidewall surface between the inner and outer surfaces, wherein covering comprises covering at least a portion of the outer surface, at least a portion of the inner surface, and at least a portion of the sidewall surface;

placing the ultra-hard body at least partially covered with the intermediate layer in a mold;

filling a portion of the mold with a substrate material; and heating the substrate material to an infiltration temperature to form a substrate coupled to the ultra-hard body, wherein a melting point of the intermediate layer exceeds the infiltration temperature.

2. The method of claim 1, wherein the ultra-hard body is selected from the group of thermally stable polycrystalline diamond bodies consisting of leached PCD, non-metal catalyst PCD, and catalyst-free PCD.

3. The method of claim 1, further comprising supporting the ultra-hard body on a displacement in the mold.

4. The method of claim 1, wherein the intermediate layer comprises a material selected from the group of materials consisting of cobalt, nickel, alloys thereof, and combinations thereof.

5. The method of claim 1, wherein covering the portion of the ultra-hard body comprises completely covering the ultra-hard body with the intermediate layer.

6. The method of claim 1, wherein covering the portion of the ultra-hard body comprises wrapping a thin metal strip around the portion of the ultra-hard body.

7. The method of claim 1, wherein covering the portion of the ultra-hard body comprises a process selected from the group of coating processes consisting of electroless plating, electroplating, vapor deposition, sputtering, spraying, and combinations thereof.

8. The method of claim 1, wherein a Young's modulus of the intermediate layer is less than a Young's modulus of the ultra-hard body and less than a Young's modulus of the substrate.

9. The method of claim 1, wherein a hardness of the intermediate layer is less than a hardness of the ultra-hard body and less than a hardness of the substrate.

10. The method of claim 1, wherein the intermediate layer comprises a first intermediate layer, and wherein the method comprises covering at least a portion of ultra-hard body with a second intermediate layer.

11. The method as recited in claim 10, wherein the first intermediate layer is a first strip and the second intermediate layer is a second strip, and wherein covering comprises covering a portion of the outer surface, a portion of the sidewall surface and a portion of the inner surface with the first strip, and covering a portion the outer surface, a portion of the sidewall surface and a portion of the inner surface with the second strip.

12. The method of claim 11, wherein the first strip and the second strip are spaced apart from each other when covering the portions of the outer surface, the sidewall surface and the inner surface.

13. The method of claim 12, further comprising supporting the ultra-hard body on a displacement in the mold.

14. The method of claim 13, wherein at least part of each of the first and second strips is sandwiched between the ultra-hard body and the displacement.

15. The method of claim 11, wherein each of the first and second strips is a metal strip.

16. The method of claim 11, wherein the first strip has a first thickness and the second strip has a second thickness different from the first thickness.

17. A method of manufacturing a cutting element comprising an ultra-hard body coupled to a substrate, the method comprising:

placing the ultra-hard body in a mold;

filling a portion of the mold with a substrate material;

heating the substrate material to an infiltration temperature to form the substrate and couple the substrate to the ultra-hard body; and removing graphitized regions of the ultra-hard body.

18. A method, comprising:

wrapping a thin metal strip around at least a portion of an ultra-hard body;

placing the ultra-hard body at least partially covered with the thin metal strip in a mold;

filling a portion of the mold with a substrate material; and heating the substrate material to an infiltration temperature to form a substrate coupled to the ultra-hard body, wherein a melting point of the thin metal strip exceeds the infiltration temperature.

* * * * *